United States Patent [19]

Troutman

[11] Patent Number: 4,465,136

[45] Date of Patent: Aug. 14, 1984

[54] PROCESS FOR ENHANCED OIL RECOVERY FROM SUBTERRANEAN FORMATIONS

[75] Inventor: Lester L. Troutman, Parker, Kans.

[73] Assignee: Joseph D. Windisch, Overland Park, Kans. ; a part interest

[21] Appl. No.: 402,733

[22] Filed: Jul. 28, 1982

[51] Int. Cl.[3] ..... E21B 43/20

[52] U.S. Cl. ..... 166/263; 166/245

[58] Field of Search ..... 166/245, 263, 268, 272, 166/303, 305 R

[56] References Cited

U.S. PATENT DOCUMENTS

| | | | |
|---|---|---|---|
| 2,421,528 | 6/1947 | Steffen | 166/303 X |
| 2,907,390 | 10/1959 | Moll et al. | 166/263 X |
| 3,032,101 | 5/1962 | Woertz et al. | 166/263 |
| 3,064,728 | 11/1962 | Gould | 166/263 X |
| 3,152,640 | 10/1964 | Marx | 166/263 X |
| 3,240,271 | 3/1966 | Ortloff | 166/263 |
| 3,252,512 | 5/1966 | Baker et al. | 166/263 |
| 3,270,809 | 9/1966 | Connally, Jr. et al. | 166/263 X |
| 3,519,076 | 7/1970 | Walker | 166/263 |
| 3,545,545 | 12/1970 | Allen | 166/273 |
| 3,548,940 | 12/1970 | Reguera et al. | 166/273 |
| 3,580,335 | 5/1971 | Allen et al. | 166/263 |
| 3,586,107 | 2/1971 | Parrish | 166/273 |
| 3,599,717 | 8/1971 | McMillen | 166/273 |
| 3,811,501 | 5/1974 | Burnett et al. | 166/273 X |
| 4,287,950 | 9/1981 | Baker et al. | 166/273 |
| 4,325,432 | 4/1982 | Henry | 166/272 X |

*Primary Examiner*—George A. Suchfield

*Attorney, Agent, or Firm*—Litman, Day & McMahon

[57] ABSTRACT

A method for recovering hydrocarbons from a subterranean hydrocarbon bearing formation comprises the steps of providing a production well penetrating in the formation and a plurality of injection wells surrounding the production well. Water is injected into the formation through the injection wells to produce a water flood barrier ringing the production well. A mixture of nitrogen and carbon dioxide gas is injected through the production well and into the formation with the water barrier acting to inhibit the escape of the gas from the portion of the formation surrounding the production well. Gas is injected through the production well into the formation until the formation is pressurized and then gas injection is ceased and the mixture of hydrocarbons and injection gas flowed from the formation through the production well.

6 Claims, 3 Drawing Figures

PROCESS FOR ENHANCED OIL RECOVERY FROM SUBTERRANEAN FORMATIONS

This invention relates to a process for recovery of hydrocarbons from a subterranean hydrocarbon bearing formation, and in particular, to such a method using combinations of water and gas injection.

BACKGROUND OF THE INVENTION

Primary production of hydrocarbons from a subterranean hydrocarbon bearing formation usually occurs by allowing the energy of the formation to drive the hydrocarbons from the formation to the surface through production wells. The field energy may be from water drive, gas cap or solution gas drive or various combinations to create a natural flow of the hydrocarbons upwardly through the production well stream. In the gas drive reservoir, gas provides the major source of energy to drive the hydrocarbons toward and up the production well. If there is no initial gas cap, the producing mechanism is a solution gas drive and as long the pressure within the formation is sufficiently high, gas remains in the solution with crude oil. As production is continued by solution or gas drive, pressure decreases to a level in which gas begins to come out of solution and forms a continuous free gas phase. The free gas then flows through the formation with little or no displacement of hydrocarbon, thereby losing the drive mechanism for the reservoir.

Secondary recovery operations typically commence when the pressure of the formation has decreased to a level indicative that energy within the formation has been substantially expended. Water flooding has often been used as a secondary recovery method and includes the injection of water into the formation through one or more injection wells. The water is forced toward the production wells, thereby resulting in washing or displacing the hydrocarbons toward the production wells and resulting in additional recovery. The water injection must necessarily be conducted under pressure greater than the pressure of the formation and depends upon various reservoir factors.

Additionally, gas injection is known as a method of secondary recovery in which gas such as air, flue as or the like is injected into the formation to attempt repressurization and recommencement of the gas drive mechanism.

OBJECTS OF THE INVENTION

The principal objects of the present invention are: to provide enhanced recovery of hydrocarbons from underground reservoir formations; to provide a recovery method or system in which gas is injected into the reservoir in combination with water driving; to provide such a system in which the water acts as a barrier to the loss of gas pressure; to provide such a system in which a mixture of nitrogen and $CO_2$ gas is injected and in part acts as a solvent to wash the oil from channel walls, sand grains, pores, vugs and the like trapping the hydrocarbons within the formation; to provide such a system which imparts sufficient natural drive to the reservoir so that in many cases, the hydrocarbons flow naturally to the surface without aid of pumps; and to provide such a method or system which is relatively inexpensive in use and particularly efficient in enhanced recovery.

Other objects and advantages of this invention will become apparent from the following description taken in conjunction with the accompanying drawings wherein are set forth, by way of illustration and example, certain embodiments of this invention.

DESCRIPTION OF THE PREFERRED EMBODIMENT

Figure 2:
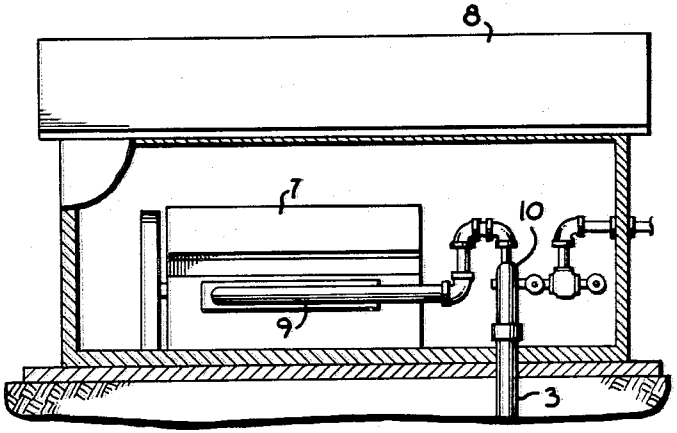
FIG. 2 is a partly diagramatic elevational view of a well head and pumping engine.

As required, detailed embodiments of the present invention are disclosed herein, however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Figure 1:
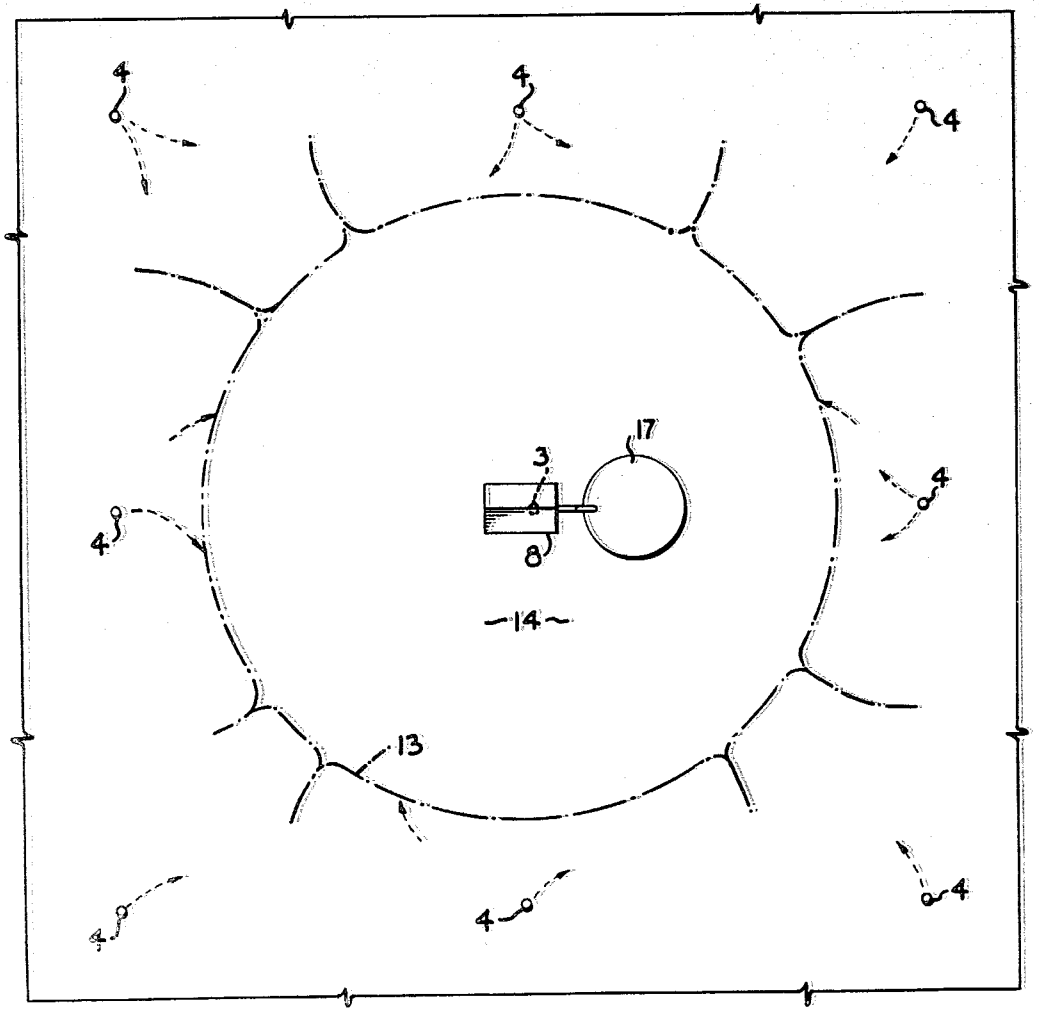
FIG. 1 is a diagramatic view of an oil field and showing an arrangement of recovery and injection wells and the representation of the practice of the method of the present invention.
Figure 3:
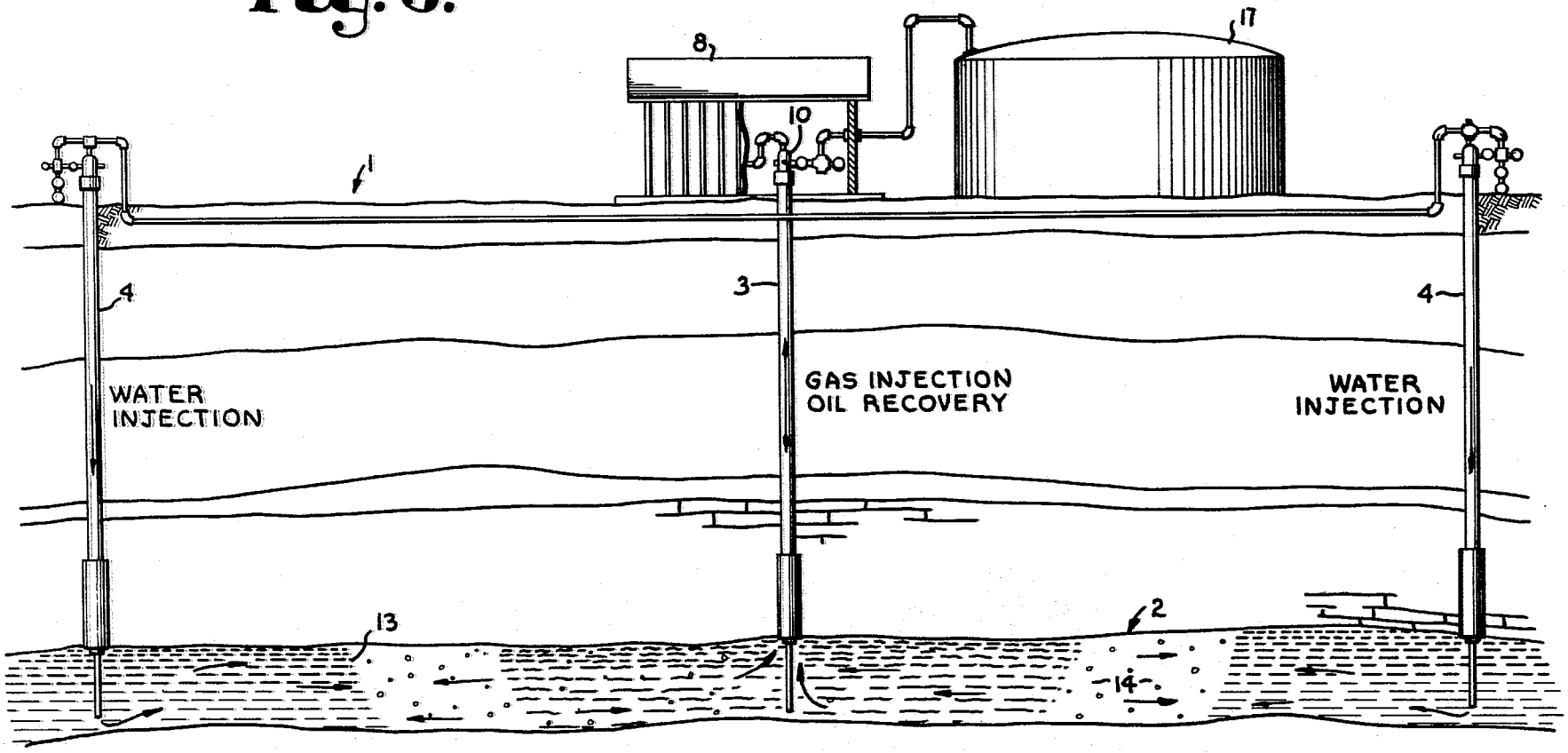
FIG. 3 is a generalized sectional view of an oil field and showing relationship of injection and recovery wells and use of the present method.

Referring to the drawings in more detail:

The reference numeral 1, FIG. 1, generally indicates an oil field which includes an underlying subterranean hydrocarbon bearing formation forming a reservoir 2, FIG. 3. The field 1 includes as a portion thereof a production well 3 extending into the reservoir 2 and a plurality of injection wells 4 surrounding the production well 3 and penetrating into the reservoir 2. In the practice of the subject method, water is injected through the injection wells 4 into the reservoir 2 and the formation is substantially continually water flooded toward the production well 3. Contemporaneously, a mixture of nitrogen and carbon dioxide gas is injected into the reservoir 2 through the production well 3 with the water from the injection wells 4 providing a barrier which inhibits the escape of the gas from the portion of the formation of reservoir 2 surrounding the production well 3. Injection of gas is continued through the production well to pressurize the portion of the reservoir. Then, the injection of gas is ceased when the portion of the reservoir within the water barrier becomes sufficiently pressurized and the hydrocarbons are flowed from the reservoir.

In the illustrated example, the wells in the field 1 are established in a rectangular grid pattern although other known arrangements can be used with substantially equal success. One or more of the wells is selected on the basis of potential recovery and designated the production well 3. The surrounding wells which ring the production well 3 are designated injection wells 4. The outer perimeter injection wells 4 are a part of another grid pattern. In accordance with the present invention, a gas is injected into the production well 3 contemporaneously with injection of water into the ringing or surrounding injection wells 4.

The gas consists of a mixture of carbon dioxide and an inert gas such as nitrogen. $CO_2$ is known as an oil recovery agent wherein recovery is improved by the advantage of the solubility of the $CO_2$ in the oil, causing viscosity reduction and swelling of the oil and leading to increased recovery. It is generally believed that the $CO_2$ is a miscible type displacing agent or becomes miscible with the oil within the reservoir in order to "wash" the oil from panels, pores, vugs and the like and break or reduce surface adhesion. The inert gas does not become miscible with the oil, but stays dispersed therefrom throughout the reservoir in a form believed to be tiny bubbles. An inert gas such as nitrogen is employed in the present example.

The preferred ratio for the $CO_2$ to inert gas is in the order of 87 to 88 percent inert gas, such as nitrogen, and 12 to 13 percent $CO_2$. A source for this gaseous mixture is shown in FIG. 2 wherein a typical well pump engine 7 is disclosed and mounted within a typical pump house shed 8. The engine 7 is an internal combustion piston engine and provides exhaust gasses through an exhaust manifold 9 which is routed into the production well 3 at the well head 10. In order to achieve a preferred mixture of 87 to 88 percent and 12 to 13 percent $CO_2$, the carburetor of the engine 7 is adjusted so that the intake mixture is full rich, resulting in very little unburned oxygen. The exhaust mixture is pumped into the well for a substantial period of time, such as between 15 and 30 days and preferably approximately 20 days, in order to pressurize the portion of the reservoir 2 in the general vicinity of the production well 3. Sufficient pressurization is measured by pressure in the well head 10 and should continue until approximately one-half to one pound of pressure per foot of depth of the reservoir formation is achieved. For example, in the portion of the Peru sand of Kansas having a reservoir depth of 300 feet below the surface, the reservoir should be gas pressurized to about 150 to 300 pounds.

Substantially simultaneously with the initiation of gas injection through the production well 3, water injection is accomplished through the surrounding injection wells 4 whereby the water flood tends to form a barrier inhibiting and trapping the injected gas with the area surrounding the production well 3. Water injection continues at the rate aforesaid throughout the entire process and conventional water injection amounts are used such as between 10 and 30 barrels of water per day injected through each well 4.

A representation of the water flood entrapped gas pressurized area is shown in FIG. 1 wherein numeral 13 designates the water flood barrier and 14 designates the gas pressurized area surrounding the production well 3.

In actual practice, simultaneous gas and water is accomplished through the respective production and injection wells 3 and 4 for a period of 15 to 30 days, such as 20 days with the gas having a content of 87 to 88 percent N and 12 to 13 percent $CO_2$. At the end of the simultaneous injection period, gas injection is ceased and the oil allowed to flow from the production well 3. Initially, the gas drive mechanism is sufficiently strong to propel the pressurized oil to the surface without the aid of mechanical pumps and when the oil comes to the surface, substantial quantities of trapped gas, presumably nitrogen can be seen bubbling from the liquid. As is conventional, the oil is routed to a storage tank 17. Gradually, gas drive pressure diminishes and the operator must resort to mechanical pumping to achieve economical flow rates. As production further decreases to 5 to 6 barrels per day, production is ceased and the cycle of simultaneous gas injection and water flooding barrier formation resumed until production becomes such a low quantity as to be uneconomical.

It is to be understood that while certain forms of the present invention have been illustrated and described herein, it is not to be limited to the specific forms or arrangement of parts described and shown.

What is claimed and desired by Letters Patent is as follows:

1. A method for recovering hydrocarbons from a subterranean hydrocarbon-bearing formation comprising the steps of:

(a) providing a production well penetrating into said formation;

(b) providing a plurality of injection wells surrounding said production well and penetrating into said formation;

(c) injecting water through said injection wells into said formation and substantially continuously water flooding said formation toward said production well;

(d) substantially simultaneously with injecting said water through said injection wells, injecting a mixture of nitrogen and carbon dioxide gas through said production well and into said formation with said water providing a barrier to escape of said gas from a portion of said formation surrounding said production well;

(e) continuing injection of said gas through said production well into said formation and pressurizing said portion of said formation;

(f) ceasing injection of said gas through said production well and flowing said hydrocarbons from said formation.

2. The method set forth in claim 1 wherein:

(a) said gas is approximately 87–88 percent nitrogen and 12–13 percent carbon dioxide.

3. The method set forth in claim 2 including:

(a) providing an internal combustion engine;

(b) operating said engine at a very rich mixture setting to provide said gas as an exhaust gas;

(c) routing said gas to said production well.

4. The method set forth in claim 1 wherein:

(a) said gas is injected into said production well at a pressure of one-half to one pound per foot of depth of said production well to said formation.

5. The method set forth in claim 1 wherein:

(a) said water is injected into said injection wells at a rate of about 10 to 30 barrels per day per well.

6. A method of recovering hydrocarbons from a subterranean hydrocarbon-bearing formation comprising the steps of:

(a) providing a production well penetrating into said formation;

(b) providing a plurality of injection wells surrounding said production well and penetrating into said formation;

(c) injecting water through said injection wells into said formation and substantially continuously water flooding said formation toward said production well;

(d) providing an internal combustion engine emitting exhaust gas comprising a mixture of about 87 to 88 percent nitrogen and 12 to 13 percent carbon dioxide and routing said gas into said production well;

(e) substantially simultaneously with injecting said water through said injection wells, injecting said gas through said production well into said formation with said water providing a barrier against escape of said gas from a portion of said formation surrounding said production well;

(f) continuing injection of said gas through said production well into said formation and pressurizing said formation to a pressure of one-half to one pound per foot of depth of said production well to said formation;

(g) ceasing injection of said gas through said production well; and (h) pumping said hydrocarbons through said production well from said formation.

* * * * *